US008118114B2

(12) United States Patent
Sugiura

(10) Patent No.: US 8,118,114 B2
(45) **Date of Patent: *Feb. 21, 2012**

(54) CLOSED-LOOP CONTROL OF ROTARY STEERABLE BLADES

(75) Inventor: Junichi Sugiura, Houston, TX (US)

(73) Assignee: Smith International Inc., Houston, TX (US)

( * ) Notice: Subject to any disclaimer, the term of this patent is extended or adjusted under 35 U.S.C. 154(b) by 410 days.

This patent is subject to a terminal disclaimer.

(21) Appl. No.: 12/396,794

(22) Filed: Mar. 3, 2009

(65) Prior Publication Data

US 2009/0166086 A1 Jul. 2, 2009

Related U.S. Application Data

(63) Continuation-in-part of application No. 12/332,911, filed on Dec. 11, 2008, now Pat. No. 7,967,081, which is a continuation-in-part of application No. 11/595,054, filed on Nov. 9, 2006, now Pat. No. 7,464,770.

(51) Int. Cl.
*E21B 21/08* (2006.01)
*E21B 7/04* (2006.01)

(52) U.S. Cl. ..... 175/25; 175/24; 175/40

(58) Field of Classification Search ..... 175/24, 175/25, 26, 40, 48

See application file for complete search history.

(56) References Cited

U.S. PATENT DOCUMENTS 2,373,880 A 4/1945 Driscoll
2,603,163 A 7/1952 Nixon
2,874,783 A 2/1959 Haines
2,880,805 A 4/1959 Nelson et al.
2,915,011 A 12/1959 Hamill
4,251,921 A 2/1981 Fink
4,407,374 A 10/1983 Wallussek et al.
4,416,339 A 11/1983 Baker et al.
4,463,814 A 8/1984 Horstmeyer et al.

(Continued)

FOREIGN PATENT DOCUMENTS

EP 1174582 A3 1/2002

(Continued)

OTHER PUBLICATIONS

Donati, F., et al.: "Innovative rotary closed loop system—Engineering concept proven by extensive field application in the Adriatic Sea", SPE39328; SPE Annual Technical Conference and Exhibition, Dallas, TX, Mar. 3-6, 1998.

(Continued)

*Primary Examiner* — Brad Harcourt
(74) *Attorney, Agent, or Firm* — Matthew Steinheider; Darla P. Fonseca; Charlotte Rutherford

(57) ABSTRACT

A steering tool has a controller configured to provide closed-loop control of blade pressure and position. In one embodiment, the controller is configured to execute a directional control methodology in which the drilling direction is controlled via control of the blade position. The pressure in each blade is further controlled within a predetermined range of pressures. This embodiment tends to prevent excessive borehole friction while at the same time reducing undesirable rotation of the blade housing. In another embodiment, the controller is configured to correlate blade pressure measurements and blade position measurements during drilling. The correlation is utilized as part of a secondary directional control scheme in the event of a downhole failure of a blade position and/or pressure sensor.

19 Claims, 6 Drawing Sheets

U.S. PATENT DOCUMENTS

| | | | | |
|---|---|---|---|---|
| 4,715,440 | A | 12/1987 | Boxell | |
| 4,844,178 | A | 7/1989 | Cendre et al. | |
| 4,947,944 | A | 8/1990 | Coltman et al. | |
| 4,957,173 | A | 9/1990 | Kinnan | |
| 4,982,383 | A | 1/1991 | Sims et al. | |
| 5,070,950 | A | 12/1991 | Cendre et al. | |
| 5,168,941 | A | 12/1992 | Krueger et al. | |
| 5,341,886 | A | 8/1994 | Patton | |
| 5,355,950 | A | 10/1994 | Zwart | |
| 5,603,386 | A | 2/1997 | Webster | |
| 5,629,480 | A | 5/1997 | Herget | |
| 5,797,453 | A | 8/1998 | Hisaw | |
| 5,941,323 | A | 8/1999 | Warren | |
| 6,148,933 | A | 11/2000 | Hay et al. | |
| 6,158,529 | A | 12/2000 | Dorel | |
| 6,233,524 | B1 | 5/2001 | Harrell et al. | |
| 6,257,356 | B1 | 7/2001 | Wassell | |
| 6,290,003 | B1 | 9/2001 | Russell | |
| 6,427,783 | B2 | 8/2002 | Krueger et al. | |
| 6,513,606 | B1 | 2/2003 | Krueger | |
| 6,609,579 | B2 | 8/2003 | Krueger et al. | |
| 6,662,110 | B1 | 12/2003 | Bargach | |
| 6,702,010 | B2 | 3/2004 | Yuratich et al. | |
| 6,761,232 | B2 | 7/2004 | Moody et al. | |
| 6,833,706 | B2 | 12/2004 | Niina | |
| 6,848,189 | B2 | 2/2005 | Moake et al. | |
| 7,377,333 | B1 | 5/2008 | Sugiura | |
| 7,464,770 | B2 * | 12/2008 | Jones et al. | 175/25 |
| 2001/0042643 | A1 | 11/2001 | Krueger et al. | |
| 2003/0056991 | A1 * | 3/2003 | Hahn et al. | 175/61 |
| 2006/0185902 | A1 | 8/2006 | Song et al. | |
| 2006/0249307 | A1 | 11/2006 | Ritter et al. | |
| 2008/0110674 | A1 | 5/2008 | Jones | |

FOREIGN PATENT DOCUMENTS

| | | | |
|---|---|---|---|
| WO | WO-98-34003 | A1 | 8/1998 |
| WO | WO-00-28188 | A1 | 5/2000 |
| WO | WO-01-51761 | A1 | 7/2001 |
| WO | WO-03-097989 | A1 | 11/2003 |

OTHER PUBLICATIONS

Moody, M., et al.: "Development and field testing of a cost-effective rotary-steerable system", SPE90482, SPE Annual Technical Conference and Exhibition, Houston, TX, Sep. 26-29, 2004.

Moody, M., et al.: "Borehole quality analysis comparing rotary-steerable tools to conventional directional drilling assemblies", AADE-05-NTCE-44, AADE National Technical Conference and Exhibition, Houston, TX, Apr. 5-7, 2005.

Sugiura, J., and Jones, S.: "Integrated approach to rotary-steerable drilling optimization using concurrent real-time measurement of near-bit borehole caliper and near-bit vibration", SPE112163, 2008 SPE Intelligent Energy Conference and Exhibition, Amsterdam, The Netherlands, Feb. 25-27, 2008.

Sugiura, J.: "Systematic testing with push-and point-the-bit rotary-steerable systems leads to the optimal BHA design for stability, steerability and borehole quality", AADE-08-DF-HO-39, AADE Technical Conference and Exhibition, Houston, TX Apr. 8-9, 2008.

International Search Report and Written Opinion dated Jul. 19, 2010 for corresponding International Application No. PCT/US2009/067651 filed Dec. 11, 2009.

* cited by examiner

CLOSED-LOOP CONTROL OF ROTARY STEERABLE BLADES

RELATED APPLICATIONS

This application is a continuation-in-part of co-pending, commonly assigned U.S. patent application Ser. No. 12/332,911 entitled Closed-Loop Physical Caliper Measurements and Directional Drilling Method, which is in turn a continuation-in-part of commonly-assigned U.S. patent application Ser. No. 11/595,054 (now U.S. Pat. No. 7,464,770) entitled Closed-Loop control of Hydraulic Pressure in a Downhole Steering Tool.

FIELD OF THE INVENTION

The present invention relates generally to downhole tools, for example, including directional drilling tools such as three-dimensional rotary steerable tools (3DRS). More particularly, embodiments of this invention relate to closed-loop control of rotary steerable blades and steering methods utilizing such control.

BACKGROUND OF THE INVENTION

Directional control has become increasingly important in the drilling of subterranean oil and gas wells, for example, to more fully exploit hydrocarbon reservoirs. Downhole steering tools, such as two-dimensional and three-dimensional rotary steerable tools, are commonly used in many drilling applications to control the direction of drilling. Such steering tools commonly include a plurality of force application members (also referred to herein as blades) that may be independently extended out from and retracted into a housing. The blades are disposed to extend outward from the housing into contact with the borehole wall. The direction of drilling may be controlled by controlling the magnitude and direction of the force or the magnitude and direction of the displacement applied to the borehole wall. In rotary steerable tools, the housing is typically deployed about a shaft, which is coupled to the drill string and disposed to transfer weight and torque from the surface (or from a mud motor) through the steering tool to the drill bit assembly.

In general, the prior art discloses at least two types of directional control mechanisms employed with rotary steerable tool deployments. U.S. Pat. Nos. 5,168,941 and 6,609,579 to Krueger et al disclose examples of rotary steerable tool deployments employing a first type of directional control mechanism. The direction of drilling is controlled by controlling the magnitude and direction of a side (lateral) force applied to the drill bit. This side force is created by extending one or more of a plurality of ribs (referred to herein as blades) into contact with the borehole wall and is controlled by controlling the pressure in each of the blades. The amount of force on each blade is controlled by controlling the hydraulic pressure at the blade, which is in turn controlled by proportional hydraulics or by switching to the maximum pressure with a controlled duty cycle. Krueger et al further disclose a hydraulic actuation mechanism in which each steering blade is independently controlled by a separate piston pump. A control valve is positioned between each piston pump and its corresponding blade to control the flow of hydraulic fluid from the pump to the blade. During drilling each of the piston pumps is operated continuously via rotation of a drive shaft.

U.S. Pat. No. 5,603,386 to Webster discloses an example of a rotary steerable tool employing a second type of directional control mechanism. Webster discloses a mechanism in which the steering tool is moved away from the center of the borehole via extension (and/or retraction) of the blades. The direction of drilling may be controlled by controlling the magnitude and direction of the offset between the tool axis and the borehole axis. The magnitude and direction of the offset are controlled by controlling the position of the blades. In general, increasing the offset (i.e., increasing the distance between the tool axis and the borehole axis) tends to increase the curvature (dogleg severity) of the borehole upon subsequent drilling. Webster also discloses a hydraulic mechanism in which all three blades are controlled via a single pump and pressure reservoir and a plurality of valves. In particular, each blade is controlled by three check valves. The nine check valves are in turn controlled by eight solenoid controlled pilot valves. Commonly assigned, co-pending U.S. patent application Ser. No. 11/061,339 employs hydraulic actuation to extend the blades and a spring biased mechanism to retract the blades. Spring biased retraction of the blades advantageously reduces the number of valves required to control the blades. The '339 application is similar to the Webster patent in that only a single pump and/or pressure reservoir is required to actuate the blades.

The above described steering tool deployments are known to be commercially serviceable. Notwithstanding, there is room for improvement of such tool deployments and directional drilling methods, especially for smaller diameter steering tool deployments (e.g., having a tool diameter of less than about 8 inches). For example, in deployments utilizing the first type of control mechanism, directional control is related to many factors including weight and stiffness of the BHA, borehole inclination, and formation harness or softness. Therefore, obtaining a consistent and predictable borehole curvature can be difficult. Deployments utilizing the second type of control mechanism require accurate position sensors and physical caliper measurements. Moreover the total force exerted against the borehole is typically not controlled. Too much force can lead to excessive drag while too little force can lead to housing roll (rotation of the blade housing in the borehole). Therefore there exists a need for improved directional drilling methods in rotary steerable deployments.

SUMMARY OF THE INVENTION

The present invention addresses the need for improved drilling methods for use in rotary steerable deployments. Aspects of this invention include a steering tool having a controller configured to provide closed-loop control of blade pressure and position. In one exemplary embodiment, the controller is configured to execute a directional control methodology in which the drilling direction is controlled via control of the blade positions. The pressure in each of the blades is also maintained within a predetermined range of pressures. Such a deployment tends to advantageously prevent borehole friction from becoming excessively high while at the same time tends to reduce housing roll via maintaining at least minimum blade pressure in each of the blades. Moreover adequate blade contact with the borehole wall is all ensured which tends to promote accurate borehole caliper measurements.

In another exemplary embodiment, the controller is configured to correlate blade pressure measurements and blade position measurements during drilling. The correlation may then be utilized as part of a secondary directional control scheme in the event of a downhole failure to one or more of the blade position or pressure sensors. The correlation is utilized, for example, to select predetermined blade pressures suitable to achieve desired blade positions (e.g., to achieve a desired tool face and offset of the steering tool housing). These embodiments tend to advantageously provide stable and reliable directional control and therefore provide a suitable backup directional control mechanism in the event of one or more sensor failures. The invention therefore has the potential to save considerable rig time.

In one aspect the present invention includes a downhole steering tool configured to operate in a borehole. The steering tool includes at least three blades deployed on a housing. The blades are disposed to extend radially outward from the housing and engage a wall of the borehole such that engagement of the blades with the borehole wall is operative to eccenter the housing in the borehole. A hydraulic module includes a fluid chamber disposed to provide pressurized fluid to each of the plurality of blades, the pressurized fluid operative to extend the blades. Each of the blades includes at least a first valve in fluid communication with high pressure fluid and at least a second valve in fluid communication with low pressure fluid. Each of the blades further includes a pressure sensor disposed to measure a fluid pressure in the blade and a position sensor disposed to measure a radial position of the blade. The steering tool further includes a controller configured to (i) lock at least one of the blades in a predetermined radially extended position by closing both the corresponding first and second valves, (ii) receive pressure measurements for each of the locked blades from the corresponding pressure sensors; and (iii) radially further extend or retract at least one of the locked blades by opening the corresponding first valve when the corresponding pressure measurement is less than a first predetermined threshold or opening the corresponding second valve when the corresponding pressure is greater than a second predetermined threshold.

In another aspect, the invention includes a method of directional drilling. The steering tool described in the preceding paragraph is first coupled with a drill string and rotated in a borehole. Each of the blades is extended to a corresponding first predetermined radial position. At least one of the blades is locked at the corresponding predetermined radial position by closing the corresponding first and second valves. A hydraulic pressure is then measured in each of the locked blades using the corresponding pressure sensors. The method further includes extending or retracting at least one of the locked blades by opening the corresponding first valve(s) when the corresponding measured pressure is less than a predetermined minimum threshold or opening the corresponding second valve(s) when the corresponding measured pressure is greater than a predetermined maximum threshold.

In still another aspect invention includes a downhole steering tool configured to operate in a borehole. The steering tool includes at least three blades deployed on a housing. The blades are disposed to extend radially outward from the housing and engage a wall of the borehole such that engagement of the blades with the borehole wall is operative to eccenter the housing in the borehole. Each of the blades includes a corresponding blade pressure sensor disposed to measure a pressure in the blade and a corresponding position sensor disposed to measure a radial position of the blade. The steering tool further includes a controller configured to (i) receive radial position measurements from each of the position sensors at a plurality of measured depths while drilling a subterranean borehole, (ii) receive corresponding pressure measurements from the pressure sensors, (iii) correlate the pressure measurements and the position measurements, (iv) use said correlation to select a set of blade pressures for achieving desired blade positions during drilling, and (v) apply the set of blade pressure to the blades.

In yet another aspect, the invention includes a method of directional drilling. The steering tool described in the preceding paragraph is first coupled with a drill string and rotated in a borehole. A radial position of each of the blades is measured at a plurality of measured depths while drilling. Corresponding hydraulic pressures are measured in each of the blades. The measured positions and pressures are then correlated and the correlation used to select a set of blade pressures for achieving desired blade radial positions during drilling. The set of blade pressures is then applied to the blades. This method is preferably, although not necessarily, used in response to a failure of at least one of the blade position sensors.

In a further aspect, the present invention includes a method of directional drilling. The method includes rotating a drill string in a borehole, the drill string including a rotary steerable tool having at least three blades deployed on a rotary steerable housing. The blades are disposed to extend radially outward from the housing and engage a wall of the borehole such that engagement of the blades with the borehole wall is operative to eccenter the housing in the borehole. The method further includes measuring a radial position and a corresponding blade pressure for each of the blades at a plurality of measured depths while drilling and correlating the measured radial positions and the corresponding measured blade pressures. The method further includes using the correlation to select either (i) a set of blade pressures for achieving a desired set of blade positions or (ii) a set of blade positions for achieving a desired set of blade pressures and applying either the set of blade pressures or the set of blade positions selected in to the blades.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
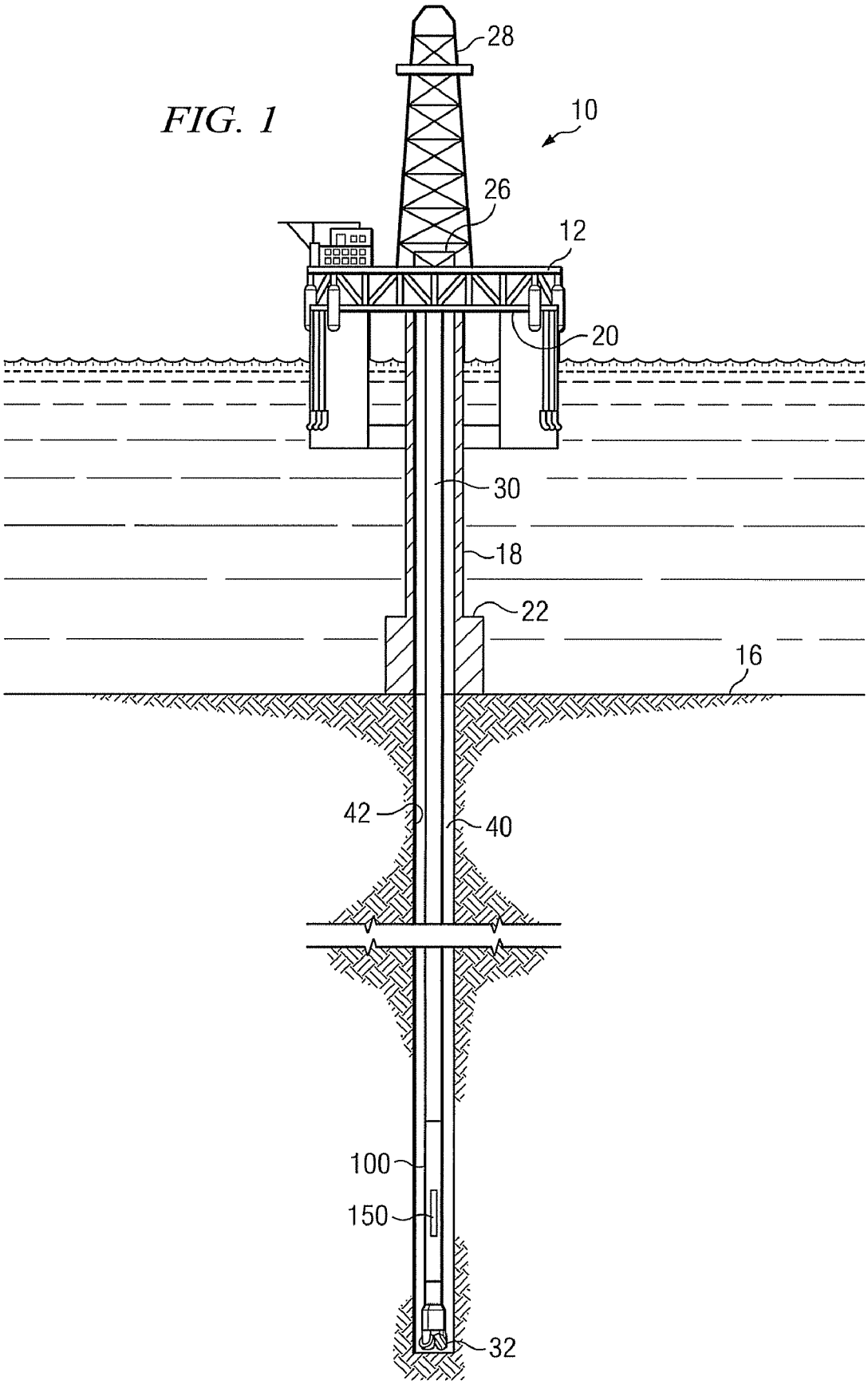
FIG. 1 depicts a drilling rig on which exemplary embodiments of the present invention may be deployed.

Referring first to FIGS. 1 through 3B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 3B may be described herein with respect to that reference numeral shown on other views.

FIG. 1 illustrates a drilling rig 10 suitable for utilizing exemplary downhole steering tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a steering tool 100 (such as a three-dimensional rotary steerable tool). In the exemplary embodiment shown, steering tool 100 includes a plurality of blades 150 (e.g., three) disposed to extend outward from the tool 100. The extension of the blades 150 into contact with the borehole wall is intended to eccenter the tool in the borehole, thereby changing an angle of approach of the drill bit 32 (which changes the direction of drilling). Exemplary embodiments of steering tool 100 further include hydraulic 130 and electronic 140 control modules (FIG. 2) configured to provide closed-loop control of system and/or blade hydraulic pressures. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. While exemplary embodiments of this invention are described below with respect to rotary steerable embodiments (e.g., including a shaft disposed to rotate relative to a housing), it will be appreciated that the invention is not limited in this regard. The invention is equally well suited for use with substantially any suitable downhole steering tools that utilize a plurality of blades to steer the drill bit.

Figure 2:
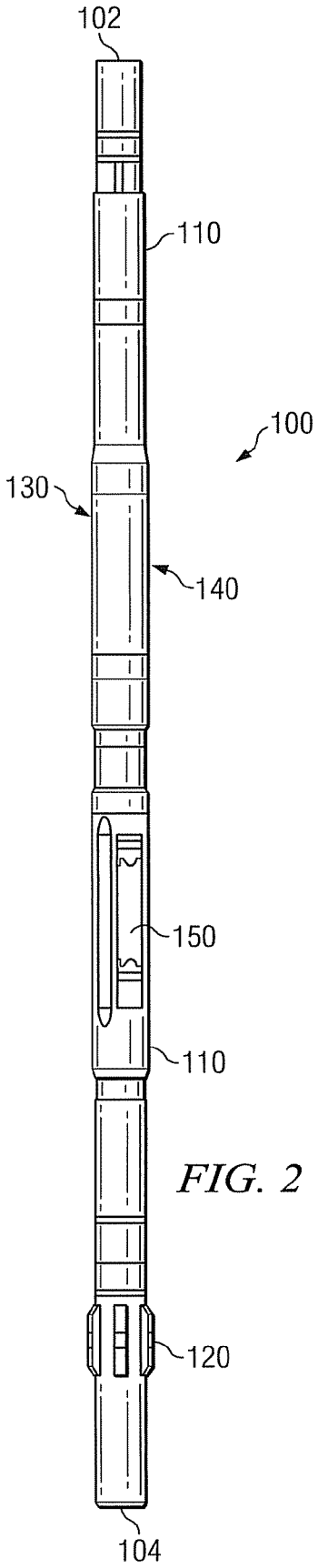
FIG. 2 is a perspective view of one exemplary embodiment of the steering tool shown on FIG. 1.

Turning now to FIG. 2, one exemplary embodiment of steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes a housing 110 and at least one blade 150 deployed, for example, in a recess (not shown) in the housing 110. Steering tool 100 further includes hydraulics 130 and electronics 140 modules (also referred to herein as control modules 130 and 140) deployed in the housing 110. In general (and as described in more detail below with respect to FIGS. 3A and 3B), the control modules 130 and 140 are configured for measuring and controlling the relative positions of the blades 150 as well as the hydraulic system and blade pressures. Control modules 130 and 140 may include substantially any devices known to those of skill in the art, such as those disclosed in U.S. Pat. No. 5,603,386 to Webster or U.S. Pat. No. 6,427,783 to Krueger et al.

Figure 3A:
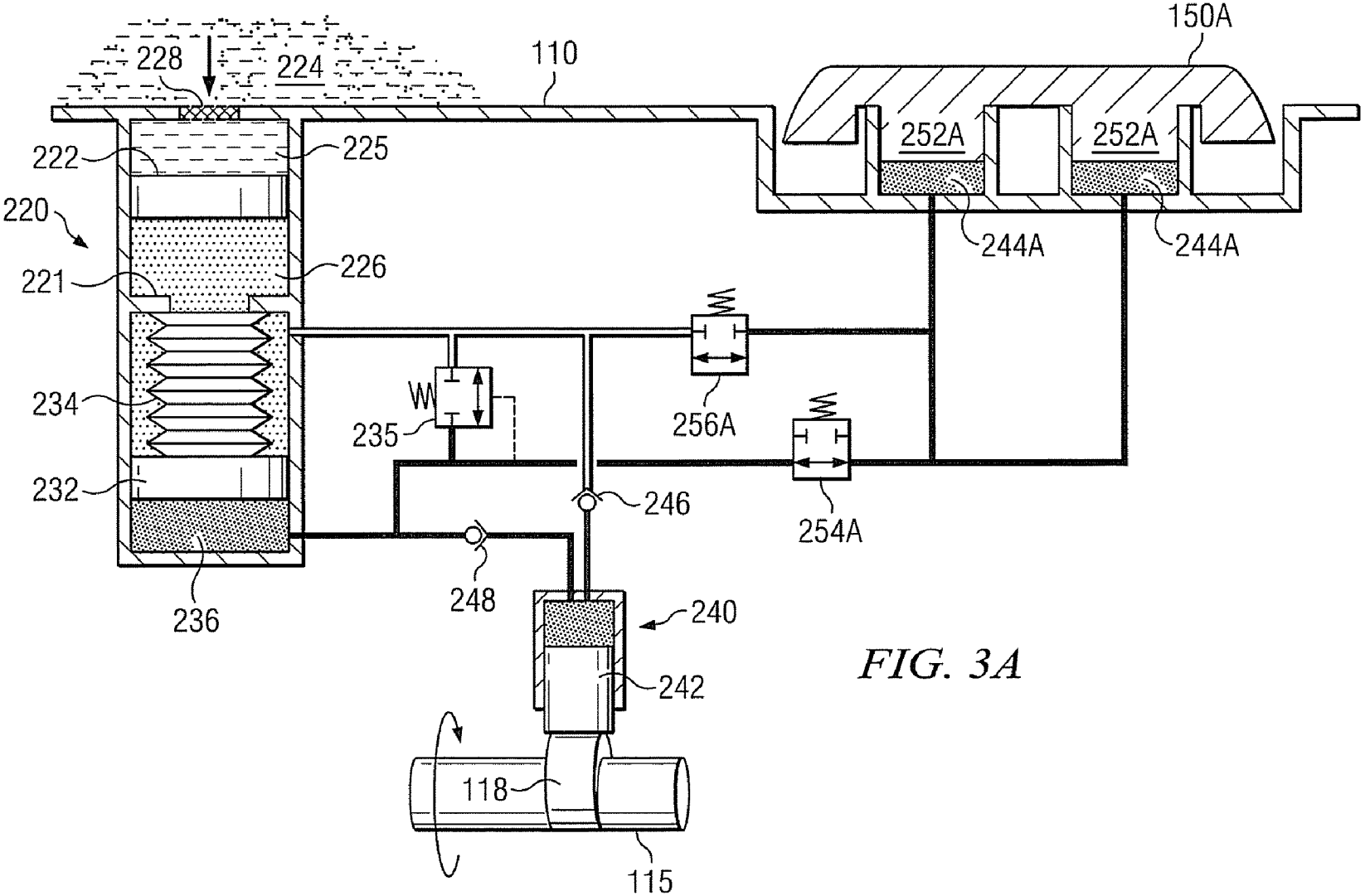
FIGS. 3A and 3B depict schematic diagrams of an exemplary hydraulic control module employed in exemplary embodiment of the steering tool shown on FIG. 2.
Figure 3B:
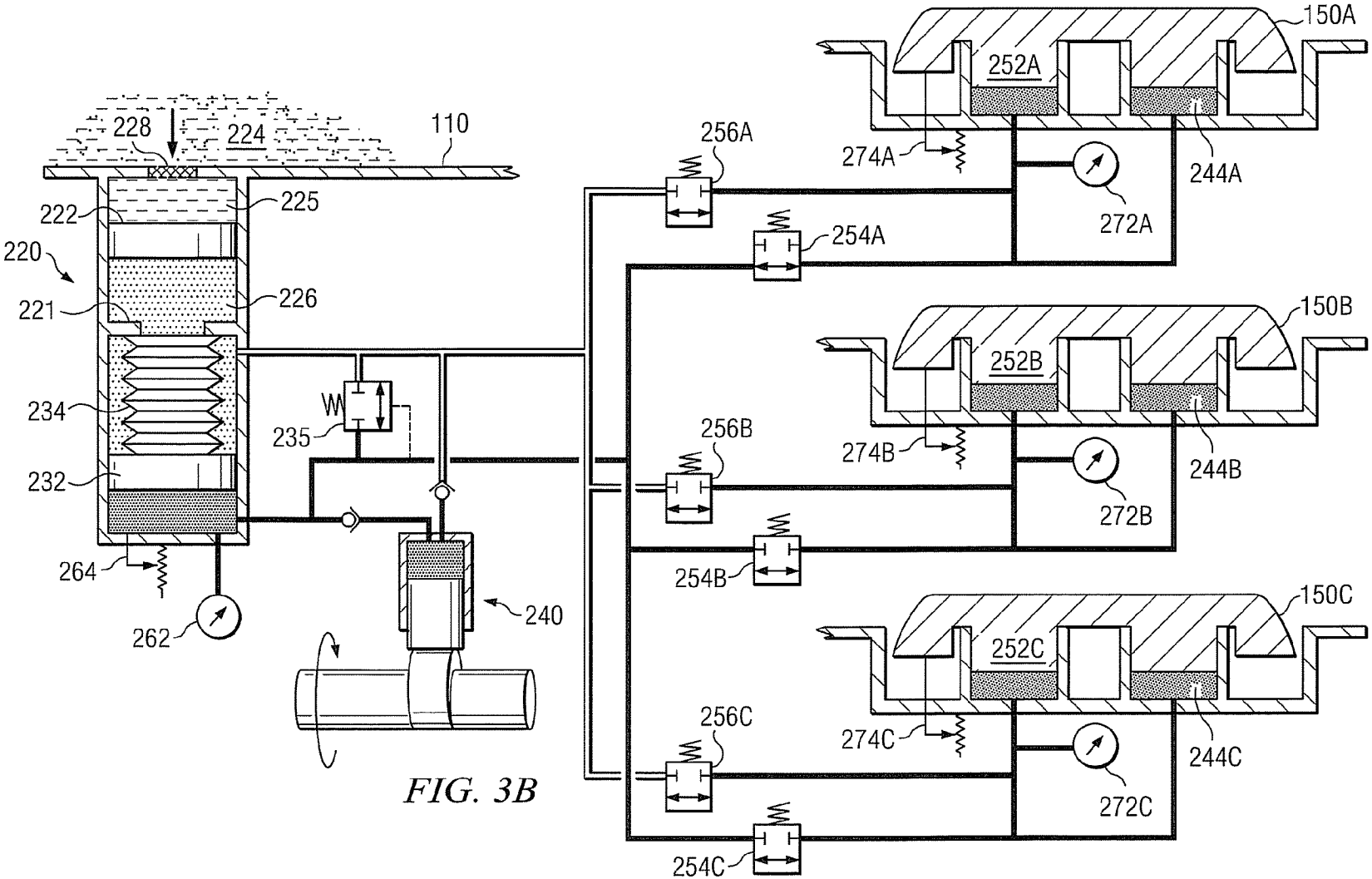

To steer (i.e., change the direction of drilling), one or more of blades 150 are extended and exert a force against the borehole wall. The steering tool 100 is moved away from the center of the borehole by this operation, altering the drilling path. It will be appreciated that the tool 100 may also be moved back towards the borehole axis if it is already eccentered. To facilitate controlled steering, the rotation rate of the housing is desirably less than 0.1 rpm during drilling, although the invention is not limited in this regard. By keeping the blades 150 in a substantially fixed position with respect to the circumference of the borehole (i.e., by preventing rotation of the housing 110), it is possible to steer the tool without constantly extending and retracting the blades 150. Non-rotary steerable embodiments are thus often only utilized in sliding mode. In rotary steerable embodiments, the tool 100 is constructed so that the housing 110, which houses the blades 150, remains stationary, or substantially stationary, with respect to the borehole during directional drilling operations. The housing 110 is therefore constructed in a rotationally non-fixed (of floating) fashion with respect to a shaft 115 (FIGS. 3A and 3B). The shaft 115 is connected with the drill string and is disposed to transfer both torque and weight to the bit. It will be understood that the invention is not limited to rotary steerable embodiments.

In general, increasing the offset (i.e., increasing the distance between the tool axis and the borehole axis) tends to increase the curvature (dogleg severity) of the borehole upon subsequent drilling. In the exemplary embodiment shown, steering tool 100 includes full-gauge near-bit stabilizer 120, and is therefore configured for "point-the-bit" steering in which the direction (tool face) of subsequent drilling tends to be in the opposite direction (or nearly the opposite; depending, for example, upon local formation characteristics) of the offset between the tool axis and the borehole axis. The invention is not limited to the mere use of a near-bit stabilizer. It is equally well suited for "push-the-bit" steering in which there is no full-gauge near-bit stabilizer and the direction of subsequent drilling tends to be in the same direction as the offset between the tool axis and borehole axis. Those of skill in the art will readily recognize that push-the-bit steering can be equally well achieved with no near-bit stabilizer or an undergauge near-bit stabilizer.

With reference now to FIGS. 3A and 3B, one exemplary embodiment of hydraulic module 130 is schematically depicted. FIG. 3A is a simplified schematic of the hydraulic module 130 showing only a single blade 150A. FIG. 3B shows each of the three blades 150A, 150B, and 150C as well as certain of the electrical control devices (which are in electronic communication with electronic control module 140). Hydraulic module 130 includes a hydraulic fluid chamber 220 including first and second, low and high pressure reservoirs 226 and 236. In the exemplary embodiment shown, low pressure reservoir 226 is modulated to wellbore (hydrostatic) pressure via equalizer piston 222. Wellbore drilling fluid 224 enters fluid cavity 225 through filter screen 228, which is deployed in the outer surface of the non-rotating housing 110. It will be readily understood to those of ordinary skill in the art that the drilling fluid in the borehole exerts a force on equalizer piston 222 proportional to the wellbore pressure, which thereby pressurizes hydraulic fluid in low pressure reservoir 226.

Hydraulic module 130 further includes a piston pump 240 operatively coupled with drive shaft 115. In the exemplary embodiment shown, pump 240 is mechanically actuated by a cam 118 formed on an outer surface of drive shaft 115, although the invention is not limited in this regard. Pump 240 may be equivalently actuated, for example, by a swash plate mounted to the outer surface of the shaft 115 or an eccentric profile formed in the outer surface of the shaft 115. In the exemplary embodiment shown, rotation of the drive shaft 115 causes cam 118 to actuate piston 242, thereby pumping pressurized hydraulic fluid to high pressure reservoir 236. Piston pump 240 receives low pressure hydraulic fluid from the low pressure reservoir 226 through inlet check valve 246 on the down-stroke of piston 242 (i.e., as cam 118 disengages piston 242). On the upstroke (i.e., when cam 118 engages piston 242), piston 242 pumps pressurized hydraulic fluid through outlet check valve 248 to the high pressure reservoir 236.

It will be understood that the invention is not limited to any particular pumping mechanism. As stated above, the invention is not limited to rotary steerable embodiments and thus is also not limited to a shaft actuated pumping mechanism. In other embodiments, an electric powered pump may be utilized, for example, powered via electrical power generated by a mud turbine and/or supplied by batteries.

Hydraulic fluid chamber 220 further includes a pressurizing spring 234 (e.g., a Belleville spring) deployed between an internal shoulder 221 of the chamber housing and a high pressure piston 232. As the high pressure reservoir 236 is filled by pump 240, high pressure piston 232 compresses spring 234, which maintains the pressure in the high pressure reservoir 236 at some predetermined pressure above wellbore pressure. Hydraulic module 130 typically (although not necessarily) further includes a pressure relief valve 235 deployed between high pressure and low pressure fluid lines. In one exemplary embodiment, a spring loaded pressure relief valve 235 opens at a differential pressure of about 750 psi, thereby limiting the pressure of the high pressure reservoir 236 to a pressure of about 750 psi above wellbore pressure. However, the invention is not limited in this regard.

With continued reference to FIGS. 3A and 3B, extension and retraction of the blades 150A, 150B, and 150C are now described. The blades 150A, 150B, and 150C are essentially identical and thus the configuration and operation thereof are described only with respect to blade 150A. Blades 150B and 150C are referred to below in reference to exemplary methods in accordance with this invention. Blade 150A includes one or more blade pistons 252A deployed in corresponding chambers 244A, which are in fluid communication with both the low and high pressure reservoirs 226 and 236 through controllable valves 254A and 256A, respectively. In the exemplary embodiment shown, valves 254A and 256A include solenoid controllable valves, although the invention is not limited in this regard.

While the invention is described with reference to a rotary steerable tool in which the blades are hydraulically actuated, it will be understood that the invention is not limited to any particular blade extension/retraction mechanism. In another suitable embodiment, the blades may be actuated with a ramp mechanism, for example, powered via electrical power generated by a mud turbine.

Referring again to the exemplary embodiment depicted on FIGS. 3A and 3B, blade 150A may be extended (radially outward from the tool body) by opening valve 254A and closing valve 256A, thereby allowing high pressure hydraulic fluid to enter chamber 244A. As chamber 244A is filled with pressurized hydraulic fluid, piston 252A is urged radially outward from the tool, which in turn urges blade 150A outward (e.g., into contact with the borehole wall). When blade 150A has been extended to a desired (predetermined) position, valve 254A may be closed, thereby "locking" the blade 150A in position (at the desired extension from the tool body). The blade is considered to be locked in position when both valves 254A and 256A are closed.

In order to retract the blade (radially inward towards the tool body), valve 256A is open (while valve 254A remains closed). Opening valve 256A allows pressurized hydraulic fluid in chamber 244A to return to the low pressure reservoir 226. Blade 150A may be urged inward (towards the tool body), for example, via spring bias and/or contact with the borehole wall. In the exemplary embodiment shown, the blade 150A is not drawn inward under the influence of a hydraulic force, although the invention is not limited in this regard.

Hydraulic module 130 may also advantageously include one or more sensors, for example, for measuring the pressure and volume of the high pressure hydraulic fluid. In the exemplary embodiment shown on FIG. 3B, sensor 262 is disposed to measure hydraulic fluid pressure in reservoir 236. Likewise, sensors 272A, 272B, and 272C are disposed to measure hydraulic fluid pressure at blades 150A, 150B, and 150C, respectively. Position sensor 264 is disposed to measure the displacement of high pressure piston 232 and therefore the volume of high pressure hydraulic fluid in reservoir 236. Position sensors 274A, 274B, and 274C are disposed to measure the displacement of blade pistons 252A, 252B, and 252C and thus the extension of blades 150A, 150B, and 150C. In one exemplary embodiment of the invention, sensors 262, 272A, 272B, and 272C each include a pressure sensitive strain gauge, while sensors 264, 274A, 274B, and 274C each include a potentiometer having a resistive wiper, however, the invention is not limited in regard to the types of pressure and volume sensors utilized. For example, in an alternative embodiment, electrical current consumption of an electromechanical motor may be used to sense blade pressure. Moreover, pressurized fluid volume (or alternatively the extension of the blades) may be measured using flow meters.

In the exemplary embodiments shown and described with respect to FIGS. 3A and 3B, hydraulic module 130 utilizes pressurized hydraulic oil in reservoirs 226 and 236. The artisan of ordinary skill will readily recognize that the invention is not limited in this regard and that pressurized drilling fluid, for example, may also be utilized to extend blades 150A, 150B, and 150C.

During a typical directional drilling application, a steering command may be received at steering tool 100, for example, via drill string rotation encoding. Exemplary drill string rotation encoding schemes are disclosed, for example, in commonly assigned U.S. Pat. Nos. 7,222,681 and 7,245,229. In prior art directional drilling methods, new blade positions are calculated based on the received steering command and each of the blades 150A, 150B, and 150C are then independently extended and/or retracted to the appropriate position (as measured by position sensors 274A, 274B, and 274C). Two of the blades (e.g., blades 150B and 150C) are commonly locked into position as described above (e.g., valves 254B, 254C, 256B, and 256C are closed). The third blade (e.g., blade 150A) preferably remains "floating" (i.e., open to high pressure hydraulic fluid via valve 256A) in order to maintain a grip on the borehole wall so that housing 110 does not rotate during drilling.

While such prior art drilling methods are commercially serviceable, there remains a need for further improvements. For example, as described above in the Background Section, such methods do not typically provide control over the force exerted by the blades on the borehole wall. Too much force has been observed to result in excessive frictional drag between the blades and the borehole wall, which tends to reduce the rate of penetration during drilling. Too little force can result in blade housing roll (excessive rotation of housing 110 in the borehole), which makes directional control more difficult owing to the need to constantly extend and retract the blades. Excessive rotation of the housing can also cause damage to the blades (due to tangential forces acting on the blades).

Figure 4:
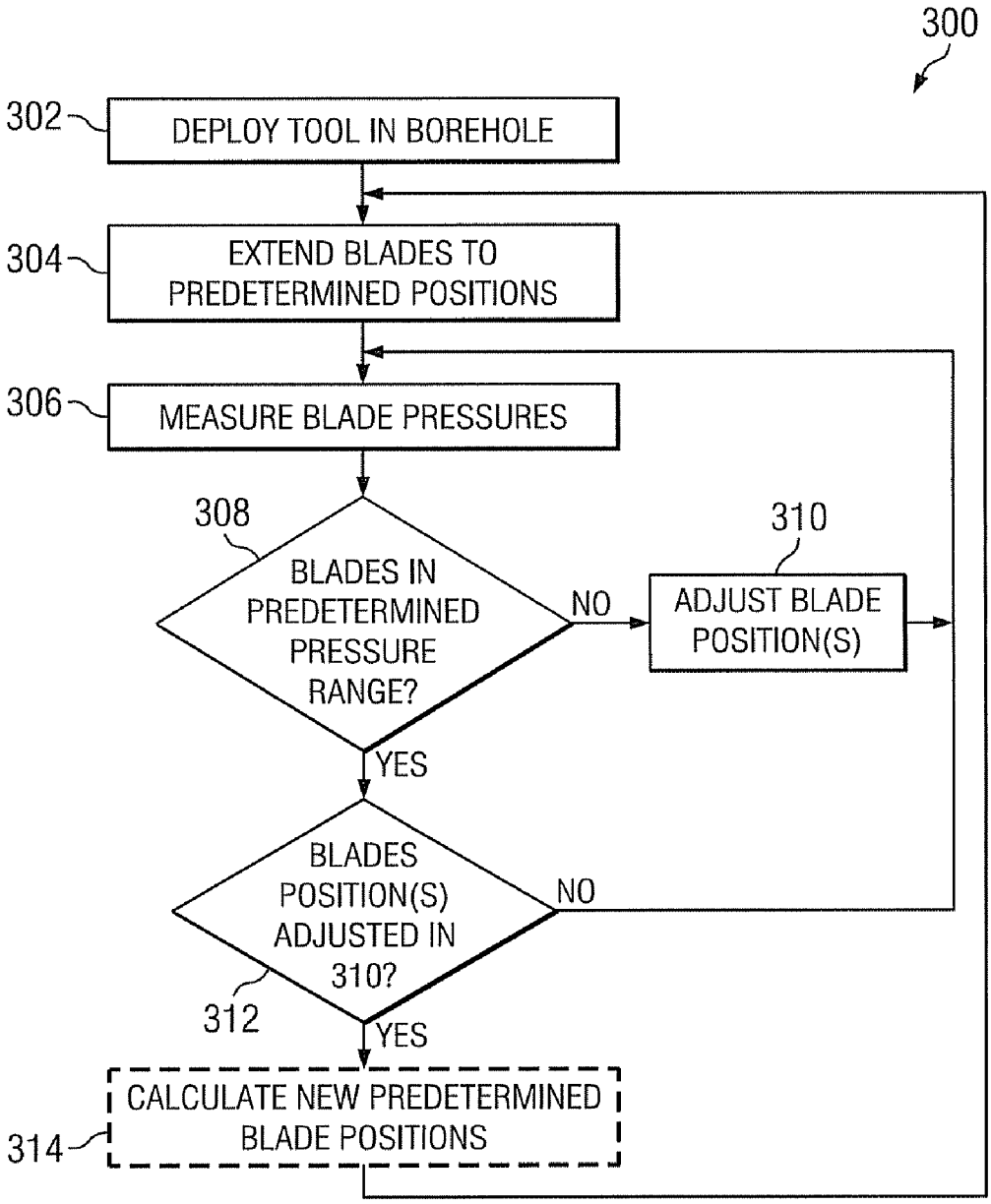
FIG. 4 depicts one exemplary method embodiment of the present invention in flowchart form.

With reference now to FIG. 4, one exemplary directional drilling method embodiment 300 in accordance with the present invention is depicted in flowchart form. At 302 a downhole tool (such as tool 100) is deployed in a subterranean borehole and drilling commences (e.g., via rotating the drill string). At 304, each of the blades is independently extended (or retracted) to a corresponding predetermined radial position (e.g., calculated based on predetermined target tool face and offset values and a measured borehole caliper). At least one blade, and preferably each of the blades, is further locked at its corresponding radial position, e.g., via closing corresponding valves 254 and 256. At 306 the hydraulic pressure is measured in each of the locked blades, e.g., using corresponding pressure sensors 272. At 308, each of the blade pressures measured in 306 is compared with a predetermined target pressure range. The predetermined target pressure range includes both an upper pressure threshold and a lower pressure threshold. While the invention is not limited to any particular pressure values, the target pressure range is typically selected to have a lower threshold value that is sufficiently high enough to resist housing roll and an upper threshold value that is sufficiently low enough to prevent excessive frictional drag between the blades and borehole wall. In one exemplary embodiment the target pressure is in the range from about 200 to about 700 psi above hydrostatic wellbore pressure.

It will be appreciated that a serviceable target pressure range may be selected based on substantially any suitable measured or expected borehole and tool parameters. Moreover the target pressure range may be selected using rule-based intelligence. Such "smart" control systems may be configured to control the target pressure range based on drilling performance and/or other steering tool measurements. For example, a failure to achieve a particular dogleg severity may trigger a controller to increase the upper threshold in the pressure range. Alternatively, excessive housing roll (e.g., as measured via a change in gravity tool face of the housing) may trigger a controller to increase the lower threshold in the pressure range. Moreover, the target pressure range may be selected from a look-up table relating various drilling parameters to the pressure range.

The frictional force of the blades on the borehole wall may be measured directly and used as an alternative and/or additional control parameter in determining a suitable target pressure range. For example, conventional strain gauges may be deployed above and below blade housing 110 (FIG. 2) and utilized to measure the near-bit weight-on-bit at both locations. It will be understood that the difference between the two weight-on-bit measurements (the weight supported by the blades) is directly proportional to the frictional force of the blades on the borehole wall. Excessive weight-on-bit loss at the blades (the difference between the two weight-on-bit measurements) may thus be used to trigger a controller to reduce the upper threshold in the target pressure range.

It will further be appreciated that numerous other borehole and/or tool parameters may be utilized to select a desired target pressure range. For example, the target pressure range may also be determined based on various measured parameters such as borehole inclination, borehole caliper, borehole curvature, LWD formation measurements, bending moments, hydraulic fluid pressure fluctuations, BHA vibration, and the like. Borehole curvature may be determined, for example, from longitudinally spaced inclination and/or azimuth measurements (e.g., at first and second longitudinal positions on the drill string) as disclosed in commonly assigned U.S. Pat. No. 7,243,719. Predetermined build rates, turn rates, DLS, and steering tool offset (the predetermined distance between the center of the borehole and the tool axis) may also utilized to determine pressure thresholds. LWD formation measurements may be used, for example, to identify known formations in which frictional forces tend to be excessive. Exemplary LWD measurements include, for example, formation density, resistivity, and various sonic velocities (also referred to reciprocally as slownesses).

It will be still further appreciated that the position-based and/or force-vector-based (pressure-vector-based) steering methods disclosed herein may further be utilized to follow pre-determined well plans, pre-determined target inclinations and/or azimuths, and/or pre-determined geological characteristics in a closed-loop manner. Such "high-level" close-loop control of the target position and/or force-vector (pressure-vector) parameters are well known in the art.

With continued reference to FIG. 4, if the pressure in each of the blades is within the target range, the controller typically waits a predetermined time (e.g., 1 second) before repeating steps 306 and 308 as indicated at 312. If the measured pressure in any of the blades is outside of the predetermined target range, then the corresponding blade is either extended or retracted at 310 (e.g., via opening either valve 254 or 256) until the measured pressure in that blade is within the target range. For example, if the target pressure in the blade is greater than the upper threshold, then the blade may be retracted via opening valve 256. Conversely, when the target pressure in the blade is less than the lower threshold the blade may be extended via opening valve 254. After the blade pressure has returned to the target range, the blade is again typically locked in position via closing valves 254 and 256.

It will be appreciated that the invention is not limited to embodiments in which a single hydraulic system controls all three blades (e.g., as depicted in FIG. 3). In one alternative embodiment, the tool may have an independent hydraulic system for each blade. Nor is the invention limited to tool embodiments utilizing solenoid controllable valves. In one alternative embodiment, servo-valves may be utilized to control the target pressure on each blade. The use of servo-valves may be advantageous in certain tool embodiments in that a servo-valve can be continuously adjusted to positions between fully open and fully closed. As such, the use of servo-valves enables the flow rate of the hydraulic fluid to be controlled and may therefore reduce the frequency of valve actuation (as compared to a binary valve which is either open or closed). Notwithstanding, the invention is not limited in these regards.

Extension or retraction of one or more of the blades in 310 (in order to maintain the blade pressure within the target range) may sometimes change the tool face and offset of the drilling tool in the borehole (depending upon the degree of extension or retraction required). Therefore it may be advantageous in certain applications to calculate new predetermined blade positions 314 when any of the locked blades have been extended or retracted in 310. New predetermined blade positions may be calculated, for example, via measuring the new blade positions, calculating the borehole caliper, and then calculating the new predetermined positions based on the borehole caliper. After calculating the new predetermined blade positions in 314, the controller may return to steps 304 so as to extend (or retract) the blades to the new predetermined positions.

The new predetermined blade positions may be calculated at 314, for example, as follows. The new blade positions are typically first measured and used to calculate a borehole caliper, for example, using equations known to those of ordinary skill in the art. The center location of the borehole in Cartesian coordinates may be calculated, for example, using the following equations:

$$X_C = \frac{(Y_3 - Y_2)(Y_3 - Y_1)(Y_2 - Y_1) + (Y_2 - Y_1)(X_3^2 - X_1^2) - (Y_3 - Y_1)(X_2^2 - X_1^2)}{2\left[\begin{array}{c}(X_3 - X_1)(Y_2 - Y_1) - \\ (X_2 - X_1)(Y_3 - Y_1)\end{array}\right]} \quad \text{Equation 1}$$

$$Y_C = \frac{(X_3 - X_2)(X_3 - X_1)(X_2 - X_1) + (X_2 - X_1)(Y_3^2 - Y_1^2) - (X_3 - X_1)(Y_2^2 - Y_1^2)}{2\left[\begin{array}{c}(X_3 - X_1)(Y_2 - Y_1) - \\ (X_2 - X_1)(Y_3 - Y_1)\end{array}\right]}$$

where $X_C$ and $Y_C$ represent the center location of the borehole in the Cartesian coordinate reference frame of the downhole tool 100. The center location of the tool is defined to be (0,0) in this reference frame. The contact points of blades 1, 2, and 3 (e.g., blades 150A, 150B, and 150C) with the borehole wall are represented in Cartesian coordinates as $(X_1,Y_1)$, $(X_2,Y_2)$, and $(X_3,Y_3)$ respectively. These contact points may be calculated, for example, from the above described blade position (extension) measurements and a corresponding gravity tool face measurement. The radius and/or the diameter of the borehole may further be calculated, for example, as follows:

$$\text{Radius} = \frac{\text{Diameter}}{2} = \frac{\sqrt{(X_1 - X_C)^2 + (Y_1 - Y_C)^2}}{2} \quad \text{Equation 2}$$

Equations 1 and 2 have been selected to minimize downhole processing time and are therefore well suited for use with downhole microcontrollers having limited processing power. Equation 1, for example, includes only subtraction, multiplication, and division steps (and no trigonometric functions). The invention is of course not limited by these equations. The artisan of ordinary skill in the art will readily be able to derive similar mathematical expressions for computing borehole caliper using blade position measurements as an input. Nor is the invention limited in any way to the reference frame in which the borehole caliper is represented. Those of ordinary skill in the art will readily be able to compute the borehole caliper in substantially any suitable reference frame or convert the borehole caliper from one reference frame to another (e.g., from Cartesian coordinates to polar coordinates and/or from a tool reference frame to a borehole reference frame).

The new blade positions may then be calculated, for example, as follows:

$$C_i = \sqrt{a^2 + b^2 + 2ab\cos\alpha_i} \quad \text{Equation 3}$$

where $C_i$ represents the predetermined blade position of the corresponding $i^{th}$ blade (e.g., blade 150A, 150B, or 150C), a represents the target offset value, and b represents the borehole radius (e.g., as computed in Equation 2). The parameter $\alpha_i$ is in units of radians and is related to the target tool face angle (the direction of the target offset) and the measured tool face angle (e.g., the measured gravity tool face) of the $i^{th}$ blade and is represented mathematically as follows:

$$\alpha_i = \pi - \gamma_i - \arcsin\frac{a\sin\gamma_i}{b}$$

where $\gamma_i$ represents the difference between the target tool face angle and the measured tool face angle of the $i^{th}$ blade.

It will be appreciated that the invention is not limited by the above described equations. Those of ordinary skill in the art will readily be able to compute blade positions based on the borehole caliper and a target tool face and offset using known trigonometric relationships. Similar equations may also be expressed in different coordinate systems (e.g. Cartesian Coordinates).

With continued reference to FIG. 4, it may be advantageous in certain embodiments of the invention to allow a "hysteresis" in the upper and lower pressure thresholds of the target range to reduce the frequency of valve actuation. This may be accomplished, for example, by using first and second unequal upper and lower thresholds. For example, first and second upper thresholds of 700 psi and 650 psi and first and second lower thresholds of 200 psi and 250 psi may be utilized. In such an exemplary embodiment, valve 254 is opened when the blade pressure drops below 200 psi, but is not closed until the blade pressure exceeds 250 psi. Likewise, valve 256 opened when the blade pressure exceeds 700 psi, but is not closed until the blade pressure drops below 650 psi. The artisan of ordinary skill in the art will readily appreciate that this 50 psi "hysteresis" tends to advantageously reduce the frequency of valve actuation. A hysteresis may also be achieved by implementing a predetermined time delay between the opening and closing of valves 254 and 256. For example, a delay of about one or two seconds often provides sufficient hysteresis. It will be appreciated that the invention is not limited in these regards.

With still further reference to FIG. 4, it will be appreciated that the predetermined positions to which the blades are extended in 304 can be frequently updated during drilling. The predetermined positions may be changed, for example, in response to a change in the gravity tool face of the housing 110. The predetermined positions may also be changed in order to change the direction of drilling, for example, in response to receiving a new steering tool command from the surface or in response to various sensor measurements utilized in closed-loop and/or geosteering applications. The invention is not limited in these regards.

As described above, accurate blade position measurements are typically required in steering deployments utilizing a blade position control scheme (the second type of directional control mechanism discussed in the Background Section). The Webster Patent discloses a rotary steerable tool in which each blade is fitted with a sensor (such as a potentiometer) for measuring the displacement of the blade. While such deployments have been utilized commercially for many years, potentiometers are known to be susceptible to mechanical wear and failure in demanding downhole environments. Such failures commonly result in the need to trip out, which results in a significant loss in rig time. In order to avoid tripping out (and the associated loss of rig time), there is a need for a backup steering methodology to overcome the loss of one or more blade position sensors.

Figure 5:
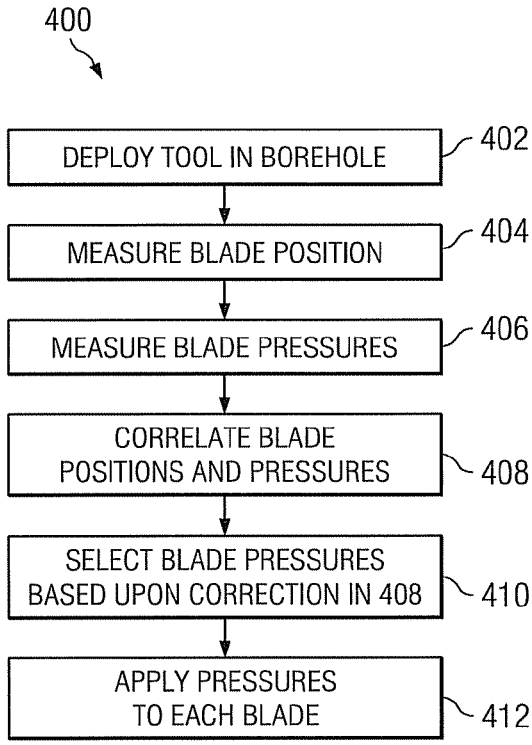
FIG. 5 depicts another exemplary method embodiment of the present invention in flowchart form.

With reference now to FIG. 5, another exemplary directional drilling method embodiment 400 in accordance with the present invention is depicted in flowchart form. Method 400 is intended to overcome the above described failure of a blade sensor and therefore may potentially (and advantageously) save considerable rig time in the event of such failures. Method 400 is similar to method 300 (depicted in FIG. 4) in that it includes deploying the steering tool in the borehole at 402. The radial position of each of the blades is measured in 404 (e.g., using position sensors 274) and the corresponding pressure in each of the blades is measured in 406 (e.g., using pressure sensors 272). At 408, the blade positions and the measured pressures are then correlated. Such position and pressure measurement and their correlation continues during drilling. For example, the controller may generate a lookup table that includes measured blade pressures as a function of predetermined or measured blade positions achieved during drilling at least a portion of a subterranean borehole. Such a correlation between the blade positions and measured pressures may then be used in steering decisions in the event of a sensor failure. For example, predetermined blade pressures may be selected in 410 for achieving desired blade positions (i.e., for achieving a desired tool face and offset of the steering tool housing in the borehole). At 412, the predetermined pressures are applied to each of the blades in order to achieve the desired blade positions. In this way directional drilling may continue despite the failure of one or more blade position sensors.

It will be appreciated that the correlation may include other steering tool and/or borehole parameters, such as borehole inclination and dogleg severity. For example, in a horizontal borehole, the blades typically need to support the weight of the BHA. Therefore, more force (pressure) may be required to achieve a particular build or drop rate in a horizontal borehole than in a vertical borehole. Moreover, it has been observed that a greater blade force (pressure) is required in order to make a course change than to maintain a particular course. For example, when the drilling direction is changed in order to build inclination (for example from a neutral position having an offset equal to 0 inches to a non-neutral position having an offset equal to 0.2 inches), the steering tool blades initially require the application of more force. However, once the steering tool enters the curved section of the borehole, less force is needed to maintain the non-neutral offset (e.g., the 0.2 inch offset).

It will be appreciated that raw sensor data may also be sent to the surface and raw control signals may be downlinked to the downhole computer via a telemetry or data-link system (e.g., a wired drilling string). By using high-speed two-way telemetry, exemplary embodiments of the invention may be implemented entirely on a surface computer.

Figure 6:
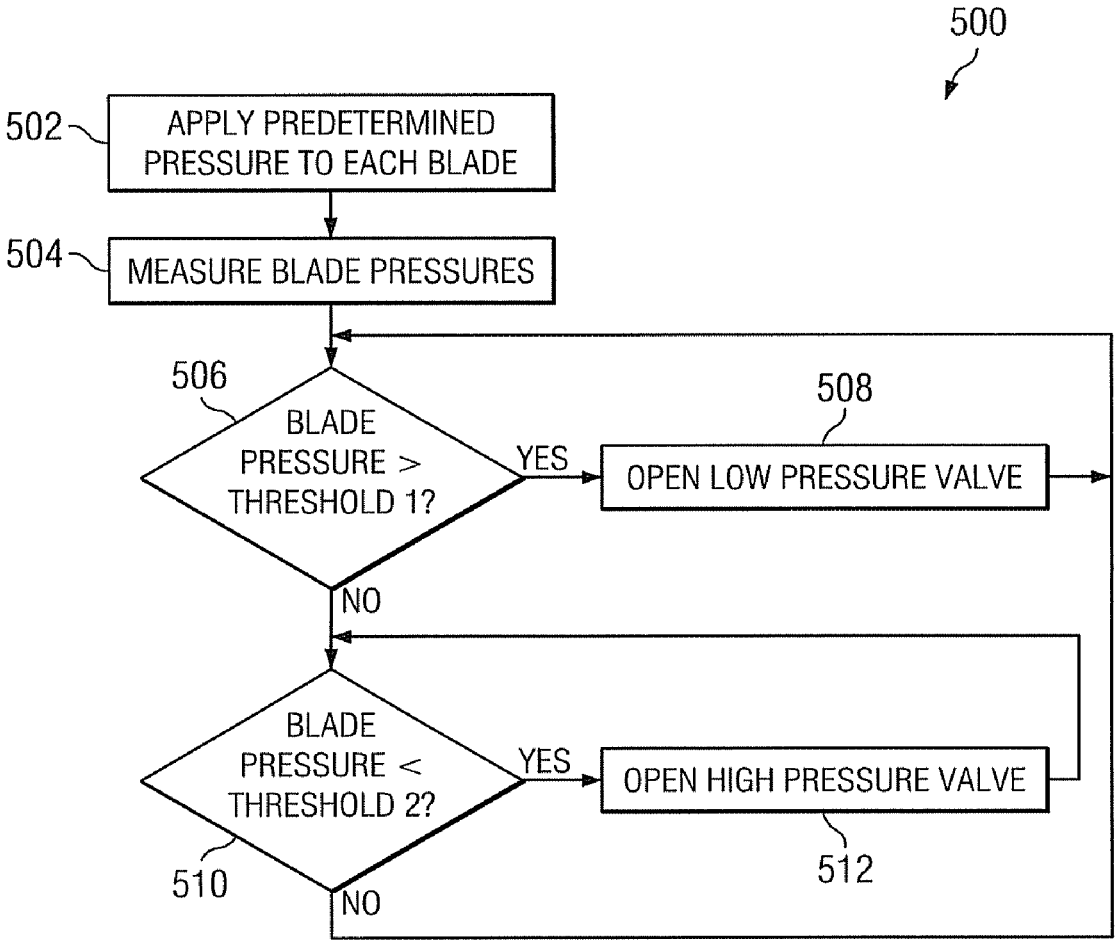
FIG. 6 depicts still another exemplary method embodiment of the present invention in flowchart form.

With reference now to FIG. 6, another exemplary directional drilling method embodiment 500 in accordance with the present invention is depicted in flowchart form. Method 500 depicts one exemplary embodiment by which the blade pressures may be controlled in block 412 of method 400. Predetermined blade pressures are applied at 502. The blade pressures are then measured at 504. If the measured blade pressure is greater than an upper threshold at 506 (e.g., 10 psi above the predetermined pressure), then valve 256 is opened at 508 so as to decrease the pressure in the blade. Valve 256 may then be closed when the pressure drops below the predetermined value. If the measured blade pressure is less than a lower threshold at 510 (e.g., 10 psi below the predetermined pressure), then valve 254 is opened at 512 so as to increase the pressure in the blade. Valve 254 may then be closed when the pressure rises above the predetermined value.

In certain embodiments it may be advantageous to implement method 500 with a duty cycle so as to conserve pressurized hydraulic fluid. For example, method 500 may be implemented for a first duration (e.g., 30 seconds) so as to achieve a stable force vector (a stable blade pressure in each of the blades). The blades may then be locked in place for a second duration (e.g., 30 seconds) via closing valves 254 and 256. The use of such a duty cycle has been found to advantageously enable high pressure reservoir 236 to remain appropriately charged with high pressure fluid while at the same time providing for stable and reliable directional control. It will be appreciated that the invention is not limited to the use of a duty cycle, to any particular duty cycle (e.g., 50% as described above), or to any particular time durations.

Methods 400 and 500 have been found to advantageously provide stable and reliable directional control and therefore provide a suitable backup directional control mechanism, for example, in the event of position sensor failure. It will be appreciated, however, that the invention is not limited to using a position-based steering mechanism as a primary method and a pressure-based force-based mechanism as a secondary method. On the contrary, the a blade pressure-based method may also be used primarily with a position-based method being used secondarily (as a back-up), for example, in the event of a pressure transducer failure.

It will be appreciated that the present invention may also be used in combination with other hydraulic system and/or blade pressure control mechanisms. For example, such control mechanisms may include those depicted on FIGS. 4 through 7 of co-pending, commonly invented, and commonly assigned, U.S. patent application Ser. No. 11/595,054 to Jones et al. (now U.S. Pat. No. 7,464,770), the specification of which is fully incorporated herein by reference.

With reference again to FIG. 2, electronics module 140 includes a digital programmable processor such as a microprocessor or a microcontroller and processor-readable or computer-readable programming code embodying logic, including instructions for controlling the function of the steering tool 100. Substantially any suitable digital processor (or processors) may be utilized, for example, including an ADSP-2191M microprocessor, available from Analog Devices, Inc.

Electronics module 140 is disposed, for example, to execute pressure control methods 300, 350, 350' and/or 400 described above. In the exemplary embodiments shown, module 140 is in electronic communication with pressure sensors 262, 272A, 272B, 272C and position sensors 264, 274A, 274B, 274C. Electronic module 140 may further include instructions to receive rotation and/or flow rate encoded commands from the surface and to cause the steering tool 100 to execute such commands upon receipt. Module 140 typically further includes at least one tri-axial arrangement of accelerometers as well as instructions for computing gravity tool face and borehole inclination (as is known to those of ordinary skill in the art). Such computations may be made using either software or hardware mechanisms (using analog or digital circuits). Electronic module 140 may also further include one or more sensors for measuring the rotation rate of the drill string (such as accelerometer deployments and/or Hall-Effect sensors) as well as instructions executing rotation rate computations. Exemplary sensor deployments and measurement methods are disclosed, for example, in commonly assigned U.S. Pat. No. 7,426,967 and co-pending, commonly assigned U.S. patent application Ser. Nos. 11/454,019 (U.S. Publication 2007/0289373).

Electronic module 140 typically includes other electronic components, such as a timer and electronic memory (e.g., volatile or non-volatile memory). The timer may include, for example, an incrementing counter, a decrementing time-out counter, or a real-time clock. Module 140 may further include a data storage device, various other sensors, other controllable components, a power supply, and the like. Electronic module 140 is typically (although not necessarily) disposed to communicate with other instruments in the drill string, such as telemetry systems that communicate with the surface and an LWD tool including various other formation sensors. Electronic communication with one or more LWD tools may be advantageous, for example, in geo-steering applications. One of ordinary skill in the art will readily recognize that the multiple functions performed by the electronic module 140 may be distributed among a number of devices.

It will also be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. One example of high-speed downhole telemetry systems is a wired drillstring, which allows high-speed two-way communications (1 Mbps available in 2008). Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

We claim:

1. A downhole steering tool configured to operate in a borehole, the steering tool comprising:

at least three blades deployed on a housing, the blades disposed to extend radially outward from the housing and engage a wall of the borehole, said engagement of the blades with the borehole wall operative to eccenter the housing in the borehole;

a hydraulic module including a fluid chamber disposed to provide pressurized fluid to each of the plurality of blades, the pressurized fluid operative to extend the blades, each of the blades including at least a first valve in fluid communication with high pressure fluid and at least a second valve in fluid communication with low pressure fluid, each of the blades further including a pressure sensor disposed to measure a fluid pressure in the blade and a position sensor disposed to measure a radial position of the blade; and a controller configured to (i) lock at least one of the blades in a predetermined radially extended position by closing both the corresponding first and second valves, (ii) receive pressure measurements for each of the locked blades from the corresponding pressure sensors; and (iii) radially further extend or retract at least one of the locked blades by opening the corresponding first valve when the corresponding pressure measurement is less than a first predetermined threshold or opening the corresponding second valve when the corresponding pressure is greater than a second predetermined threshold.

2. The downhole steering tool of claim 1, wherein the controller is configured to lock each of the blades at corresponding predetermined radially extended positions by closing the corresponding first and second valves.

3. The downhole steering tool of claim 1, further comprising a shaft deployed in the housing, the housing and shaft disposed to rotate substantially freely with respect to one another about a longitudinal axis of the steering tool.

4. The downhole steering tool of claim 1, wherein the controller is further configured to (iv) compute a new predetermined radial position for at least one of the blades and (v) lock said blade in the new predetermined radial position by closing both the corresponding first and second valves.

5. A downhole steering tool configured to operate in a borehole, the steering tool comprising:

at least three blades deployed on a housing, the blades disposed to extend radially outward from the housing and engage a wall of the borehole, said engagement of the blades with the borehole wall operative to eccenter the housing in the borehole;

each of the blades including a corresponding blade pressure sensor disposed to measure a pressure in the blade and a corresponding position sensor disposed to measure a radial position of the blade; and a controller configured to (i) receive radial position measurements from each of the position sensors at a plurality of measured depths while drilling a subterranean borehole, (ii) receive corresponding pressure measurements from the pressure sensors, (iii) correlate the pressure measurements and the position measurements, (iv) use said correlation to select a set of blade pressures for achieving desired blade positions during drilling, and (v) apply the set of blade pressure to the blades.

6. The downhole steering tool of claim 5, further comprising:

a hydraulic module including a fluid chamber disposed to provide pressurized fluid to each of the plurality of blades, the pressurized fluid operative to extend the blades.

7. The downhole steering tool of claim 5, wherein the controller is further configured to selected the set of blade pressures in (iv) in response to a failure of at least one of the position sensors.

8. A method of directional drilling, comprising:

(a) rotating a drill string in a borehole, the drill string including a rotary steerable tool having at least three blades deployed on a rotary steerable housing, the blades disposed to extend radially outward from the housing and engage a wall of the borehole, said engagement of the blades with the borehole wall operative to eccenter the housing in the borehole, each of the blades including at least a first valve in fluid communication with high pressure fluid and at least a second valve in fluid communication with low pressure fluid, each of the blades further including a corresponding pressure sensor disposed to measure a hydraulic fluid pressure in the blade and a position sensor disposed to measure a radial position of the blade;

(b) extending each of the blades to a corresponding first predetermined radial position;

(c) locking at least one of the blades at the corresponding predetermined radial position by closing the corresponding first and second valves;

(d) measuring a hydraulic pressure in each of the locked blades; and (e) further extending or retracting at least one of the locked blades by opening the corresponding first valve(s) when the corresponding hydraulic pressure measured in (d) is less than a predetermined minimum threshold or opening the corresponding second valve(s) when the corresponding hydraulic pressure measured in (d) is greater than a predetermined maximum threshold.

9. The method of claim 8 wherein each of said blades is locked in (c).

10. The method of claim 8, further comprising:

(f) measuring a new blade position for each of the blades after said extension or retraction of at least one of the locked blades in (e); and (g) calculating second predetermined blade positions for each of the blades;

(h) repositioning the blades to the second predetermined blade positions calculated in (g); and (i) locking at least one of the blades at the corresponding second predetermined position by closing the corresponding first and second valves.

11. The method of claim 10, wherein each of said blades is locked in (c).

12. A method of directional drilling comprising:

(a) rotating a drill string in a borehole, the drill string including a rotary steerable tool having at least three blades deployed on a rotary steerable housing, the blades disposed to extend radially outward from the housing and engage a wall of the borehole, said engagement of the blades with the borehole wall operative to eccenter the housing in the borehole, each of the blades including at least a first valve in fluid communication with high pressure fluid and at least a second valve in fluid communication with low pressure fluid, each of the blades further including a corresponding pressure sensor disposed to measure a hydraulic fluid pressure in the blade and a position sensor disposed to measure a radial position of the blade;

(b) measuring a radial position of each of the blades at a plurality of measured depths while drilling;

(c) measuring corresponding hydraulic pressures in each of the blades;

(d) correlating the radial positions measured in (b) and the hydraulic pressures measured in (c);

(e) using said correlation to select a set of blade pressures for achieving desired blade radial positions during drilling; and (f) applying the set of blade pressures to the blades.

13. The method of claim 12, wherein using said correlation in (e) and applying the pressures in (f) is in response to a failure of at least one of the position sensors.

14. The method of claim 12, wherein (f) further comprises:

(i) measuring the pressure in each of the blades;

(ii) opening the corresponding first valve when the measured pressure is less the corresponding pressure selected in (e); and (iii) opening the corresponding second valve when the measured pressure is greater than the corresponding pressure selected in (e).

15. The method of claim 12, wherein (f) further comprises:

(i) applying the set of blade pressures to the blades during a first time period;

(ii) locking each of the blades via closing each of the corresponding first and second valves during a second time period; and (iii) repeating (i) and (ii).

16. The method of claim 15, wherein the first time period is about equal to the second time period.

17. A method of directional drilling comprising:

(a) rotating a drill string in a borehole, the drill string including a rotary steerable tool having at least three blades deployed on a rotary steerable housing, the blades disposed to extend radially outward from the housing and engage a wall of the borehole, said engagement of the blades with the borehole wall operative to eccenter the housing in the borehole;

(b) measuring a radial position and a corresponding blade pressure for each of the blades at a plurality of measured depths while drilling;

(c) correlating the radial positions and the corresponding blade pressures measured in (b);

(d) using said correlation to select either (i) a set of blade pressures for achieving a desired set of blade positions or (ii) a set of blade positions for achieving a desired set of blade pressures; and (e) applying either the set of blade pressures or the set of blade positions selected in (d) to the blades.

18. The method of claim 17, wherein:

(d) comprises using said correlation to select a set of blade pressures for achieving a desired set of blade positions; and (e) comprises applying the set of blade pressures selected in (d) to the blades.

19. The method of claim 17, wherein using said correlation in (d) and applying the pressures in (e) is in response to a failure of at least one blade position sensor.

* * * * *